US009610210B2

(12) United States Patent
Swiniarski

(10) Patent No.: US 9,610,210 B2
(45) Date of Patent: Apr. 4, 2017

(54) WALKER WITH ADJUSTABLE STRAP

(71) Applicant: Eagle Petroleum, Corp., Arvada, CO (US)

(72) Inventor: John Swiniarski, Arvada, CO (US)

( * ) Notice: Subject to any disclaimer, the term of this patent is extended or adjusted under 35 U.S.C. 154(b) by 0 days.

(21) Appl. No.: 14/626,597

(22) Filed: Feb. 19, 2015

(65) Prior Publication Data

US 2015/0238381 A1 Aug. 27, 2015

Related U.S. Application Data

(60) Provisional application No. 61/966,587, filed on Feb. 27, 2014.

(51) Int. Cl.
*A61H 3/00* (2006.01)
*A61H 3/04* (2006.01)

(52) U.S. Cl.
CPC ..... *A61H 3/00* (2013.01); *A61H 3/04* (2013.01); *A61H 2201/0161* (2013.01); *A61H 2201/0188* (2013.01); *A61H 2201/0192* (2013.01); *A61H 2201/1633* (2013.01)

(58) Field of Classification Search
CPC .... A61H 3/00; A61H 3/04; A61H 2201/1633; A61H 3/008
USPC ..... 135/67; 280/87.051, 87.021, 87.041; 482/66, 68
See application file for complete search history.

(56) References Cited

U.S. PATENT DOCUMENTS

| | | | | |
|---|---|---|---|---|
| 3,778,052 | A | 12/1973 | Andow et al. | |
| 4,342,465 | A | 8/1982 | Stillings | |
| 4,449,750 | A | 5/1984 | Pultman | |
| 4,491,257 | A | 1/1985 | Ingles | |
| 4,621,804 | A | 11/1986 | Mueller | |
| 4,953,851 | A | 9/1990 | Sherlock et al. | |
| 5,040,556 | A * | 8/1991 | Raines | A61H 3/00 135/67 |
| 5,174,590 | A * | 12/1992 | Kerley | A61H 3/008 280/1.5 |
| 5,255,697 | A * | 10/1993 | Grauer | A61H 3/04 135/67 |
| 5,476,432 | A | 12/1995 | Dickens | |
| 5,704,682 | A | 1/1998 | Gorayeb et al. | |
| 6,056,673 | A * | 5/2000 | Arrecis | A61H 3/00 135/67 |
| 6,170,840 | B1 * | 1/2001 | Mathias | A63B 69/0064 135/69 |
| 6,527,285 | B1 * | 3/2003 | Calandro, II | A61H 3/04 280/650 |
| 6,595,530 | B2 | 7/2003 | Wood | |
| 6,742,523 | B2 * | 6/2004 | Dubats | A61H 3/008 128/875 |
| 7,506,657 | B2 | 3/2009 | Hsiao | |

(Continued)

*Primary Examiner* — Noah Chandler Hawk
(74) *Attorney, Agent, or Firm* — Sheridan Ross P.C.

(57) ABSTRACT

A walker for assisting persons with varying degrees of physical ability is provided with an adjustable strap. A user opens a portion of the walker and enters the walker, and then the user closes the portion of the walker to enclose himself or herself in the walker. The user is positioned over an adjustable strap, and the adjustable strap is in an extended position. The adjustable strap may then be retracted such that a seat disposed on the adjustable strap rises and contacts the user to bear at least a portion of the user's weight.

16 Claims, 8 Drawing Sheets

(56) References Cited

U.S. PATENT DOCUMENTS

| | | | | |
|---|---|---|---|---|
| 7,735,499 | B1 * | 6/2010 | Pennise | A61H 3/04 135/67 |
| 8,267,803 | B2 * | 9/2012 | Trapp | A47D 13/107 446/227 |
| 8,720,914 | B1 | 5/2014 | Heath et al. | |
| 2005/0183759 | A1 * | 8/2005 | Wolfe | A61H 3/04 135/67 |
| 2008/0007020 | A1 | 1/2008 | Holman | |
| 2010/0170546 | A1 * | 7/2010 | Popovic | A61H 3/008 135/67 |
| 2010/0288575 | A1 * | 11/2010 | Irvine | A61H 3/008 180/330 |
| 2015/0224014 | A1 * | 8/2015 | Cook | A61H 3/04 280/657 |
| 2015/0342822 | A1 * | 12/2015 | Osterhaus | A61H 3/04 280/657 |

* cited by examiner

WALKER WITH ADJUSTABLE STRAP

CROSS REFERENCE TO RELATED APPLICATIONS

The present application claims the benefits of and priority, under 35 U.S.C. §119(e), to U.S. Provisional Application Ser. No. 61/966,587, filed on Feb. 27, 2014, which is incorporated herein in its entirety by reference.

BACKGROUND

Walkers are commonly known in the art as devices that help persons with a limited ability to walk unassisted. These persons include the elderly, persons with degenerative conditions or other disabilities, and any other person in need of a balanced platform to attain mobility.

Currently, there are many models and variations of walkers, but these walkers operate in generally the same way. First, a structure partially surrounds the user to provide stability in a plurality of directions. Next, the user engages the walker to travel in a given direction. In some models of walkers, the user picks the walker up and places the walker in a position forward of the user. Then the user moves toward the walker aided by the stability of the walker. In other models of walkers, the walker includes wheels or skis between the structure of the walker and the ground. Thus, the user may simply push the walker to a position forward of the user. Then, as before, the user moves toward the walker aided by the stability of the walker.

In some modern versions of walkers, the structure of the walker fully encloses the user. In other words, the walker forms a perimeter completely around the user. Examples of these walkers may be found in U.S. Pat. Nos. 8,720,914; 5,476,432; 4,621,804; and 4,342,465, which are incorporated herein in their entirety by reference. These walkers include a pivoting portion such that a user may enter the center of the walker, then the pivoting portion rotates to enclose the user within the walker. Once in the center of the walker, these devices typically include a seat, pad, or other similar device for the user to sit on.

While these more robust walkers provide greater stability, these walkers are difficult to enter and sit on the seat or pad, and a user requires the help of one or more assistants to enter these walkers and position himself or herself on the seat or pad. For example, the walker in the '914 patent has a seat that is attached to the frame of the walker with carabiners. Presumably, the user would either have to lift his or her legs into the seat without removing the carabiners or enter the walker and selectively attach the carabiners to the frame of the walker to attach the seat. Either scenario would be difficult for a user who is so limited in walking ability that the user requires a fully enclosed walker with a seat.

Therefore, there is a need for a robust walker that fully encloses a user and includes a seat wherein the walker may be used without the aid of an assistant or additional person.

SUMMARY

There is a need for a walker, which can enclose the user, and allow the user to engage the walker without the help of an assistant. These and other needs are addressed by the various aspects, embodiments, and/or configurations of the present disclosure. Also, while the disclosure is presented in terms of exemplary and optional embodiments, it should be appreciated that individual aspects of the disclosure can be separately claimed.

One aspect of the present invention is to provide a walker with an adjustable strap where the user does not need the assistance of another person to use the walker. In some embodiments of the present invention, the adjustable strap is fully extended when a pivoting portion is in an open position. After the user enters the walker and closes the pivoting portion, the user positions the adjustable strap between the user's legs. Once activated, the adjustable strap retracts from the fully extended position and a seat disposed on the adjustable strap contacts the user to bear at least some of the user's weight. Thus, the user has entered the fully enclosed walker and engaged the seat without the assistance of another person.

It is another aspect of the present invention to provide a walker with an adjustable strap that retracts automatically upon a trigger event. As the user enters the walker and closes the pivoting portion, the pivoting portion functions as a trigger event, and the adjustable strap retracts such that a seat disposed on the adjustable strap contacts the user and bears at least some of the user's weight. In some embodiments, the closing of the pivoting portion may complete an electrical circuit that signals for the retraction of the adjustable strap. In other embodiments, a position sensor may determine that the position of the pivoting portion is in the closed position, which signals for the retraction of the adjustable strap. The retraction of the adjustable strap need not occur instantaneously with the trigger event. A time delay may be included to provide the user time to position the adjustable strap between his and/or her legs. One skilled in the art will appreciate various trigger events to retract the adjustable strap as well as different delay periods.

It is an aspect of various embodiments of the present invention to provide a walker with an adjustable strap that retracts and/or extends manually upon input from the user. For example, in some embodiments, the walker may include a button on the rear portion of the walker to signal the adjustable strap to extend into the fully unreeled position. The user may then enter the walker, close the pivoting portion, and position the adjustable strap and/or seat between the user's legs. The user may then press a second button located on the forward portion of the walker to signal the adjustable strap of seat to retract, and the seat contacts the user to bear at least some of the user's weight. One skilled in the art may appreciate a variety of locations on the walker for the retract and extend buttons, and one skilled in the art may also appreciate that the retract and extend buttons may be combined into a single button. One skilled in the art will also appreciate that the adjustable strap may start in various initial positions. For example, the adjustable strap may be fully unreeled in a default state. In various embodiments, the adjustable strap may be retracted in a default state, and the user must extend the adjustable strap to an unreeled state before entering the walker.

It is an aspect of the present invention to provide a walker with an adjustable strap where a seat disposed on the adjustable strap or the adjustable strap itself bears at least some of the user's weight upon retraction of the adjustable strap. In some embodiments, the adjustable strap retracts to certain position and may bear the entire weight of the user. In this configuration, the user may simply sit when the user is not moving the walker. In other embodiments, the adjustable strap retracts to bear a certain weight, for example, 50 lbs. Thus, the user does not have to bear all of his or her own weight, but the user still bears some weight. In yet further embodiments, the adjustable strap contacts the user and only bears a negligible amount or none of the user's weight. In these embodiments, the adjustable strap acts more as a reference frame for the user to aid in the user's walking.

It is another aspect of the present invention to provide a walker with an adjustable strap that may comprise a variety of straps and/or seats. In some embodiments, the walker comprises a simple flat strap like a tow strap. These straps may be a variety of sizes and shapes. For example, in one embodiment, the strap is a larger diameter near the structure of the walker, and the strap tapers to a smaller diameter near the user's legs such that a larger strap size does not impede the walking motion of the user. In other embodiments, the walker comprises a seat that is attached to a strap or wire. The seat may be similar in appearance to a bicycle seat or any other seat. Embodiments that include such a seat may be more apt for walkers that bear a substantial portion of the user's weight. One skilled in the art will appreciate a variety of strap and sitting devices.

One particular embodiment of the present invention is a walker for assisting a user, comprising a frame partially enclosing a user region, the frame oriented substantially horizontal to a ground surface; a plurality of legs connected to the frame and descending downwardly from the frame; a rear portion having a proximate end and a distal end, the proximate end rotatably connected to the frame, wherein the rear portion rotates about the rotatable connection such that the distal end selectively connects to and disconnects from the frame, which fully encloses the user region; an adjustable strap having a first end, a second end, and a length between the first and second ends; a retraction device disposed on the walker, wherein the first end of the adjustable strap is operatively connected to the retraction device, and the second end is connected to the walker, wherein the retraction device retracts and extends the adjustable strap between a first length and a second length, wherein the first length is longer than the second length; and a seat disposed between the first end and the second end of the adjustable strap, wherein when the retraction device retracts the adjustable strap to the second length the seat contacts the user and bears at least some of the user's weight.

Another particular embodiment of the present invention is a method for adjusting the strap of a walker, comprising providing a walker, comprising a frame partially enclosing a user region, the frame oriented generally horizontal to a ground surface; a plurality of legs connected to the frame and descending downwardly from the frame; a rear portion having a proximate end and a distal end, the proximate end rotatably connected to the frame; an adjustable strap having a first end, a second end, and a length between the first and second ends, wherein the first end is operatively connected to the walker, and the second end is connected to the walker; a seat disposed between the first end and the second end of the adjustable strap; positioning a person within the user region, wherein the person is centered over the adjustable strap and the seat, and wherein the adjustable strap is extended to a first length; rotating the rear portion to selectively connect to the frame and enclose the user region; and retracting the adjustable strap from the first length to a second length, wherein the second length is shorter than the first length, and wherein the seat contacts the user and bears at least some of the user's weight.

Yet another particular embodiment of the present invention is a walker for assisting a user, comprising a plurality of legs connected to the frame and descending downwardly from the frame; a rear portion having a proximate end and a distal end, the proximate end rotatably connected to the frame, wherein the rear portion rotates about the rotatable connection such that the distal end selectively connects to and disconnects from the frame, which fully encloses the user region; an adjustable strap having a first end, a second end, and a length between the first and second ends; a retraction device disposed on the walker, wherein the first end of the adjustable strap is operatively connected to the retraction device, and the second end is connected to the walker, wherein the retraction device retracts and extends the adjustable strap between a first length and a second length, wherein the first length is longer than the second length; and a seat disposed between the first end and the second end of the adjustable strap, wherein when the retraction device retracts the adjustable strap to the second length the seat contacts the user and bears at least some of the user's weight; wherein the plurality of legs descends downwardly and an angle perpendicular to the frame, and wherein a distal end of the plurality of legs comprises a wheel.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference letter or label.

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Further, terms such as "pivoting portion" and "rear portion" and other terms may be used interchangeably in some instances.

Figure 1:
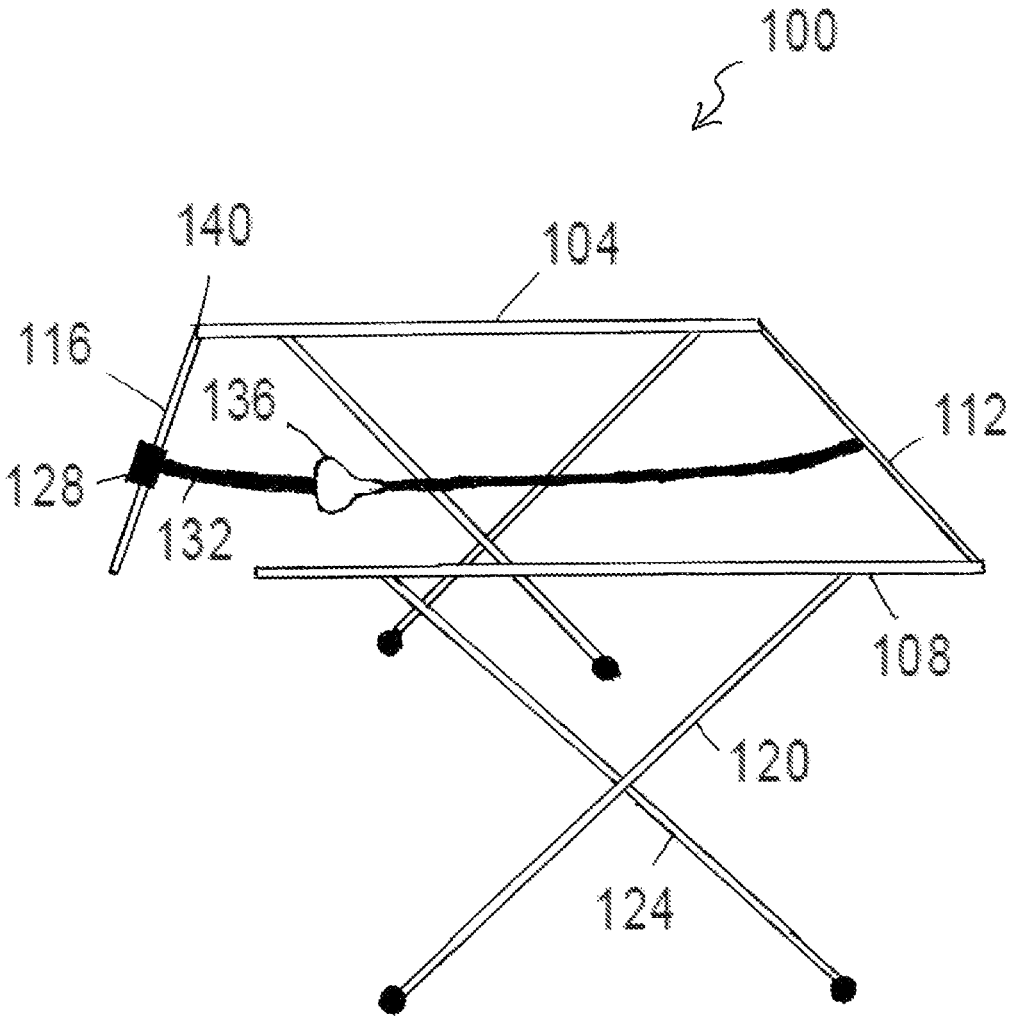
FIG. 1 depicts an isometric view of an embodiment of a walker with an adjustable strap.

A walker 100 with an adjustable strap 132 is shown in FIG. 1. The walker 100 in this particular embodiment comprises four portions disposed around the perimeter of the walker 100. A right portion 108 is rigidly connected to a front portion 112, which is rigidly connected to a left portion 104. The connection between the left portion 104 and a rear portion 116 is a hinged connection 140 such that the rear portion 116 is rotatable about the hinged connection 140 relative to the remaining portions 104, 108, 112. One skilled in the art will appreciate further embodiments where the connections between the portions 104, 108, 112 are not rigid. Rather, in alternative embodiments the connections may be hinged or otherwise mobile to allow for articulation between the portions 104, 108, 112. Similarly, one skilled in the art will appreciate embodiments where the portions 104, 108, 112 are a single continuous portion.

When the walker 100 is in a closed position, the rear portion 116 rotates about the hinged connection 140 and a distal end of the rear portion 116 contacts a first end of the right portion 108. The distal end of the rear portion 116 and the first end of the right portion 108 may selectively connect to define a user region and secure and fully enclose the user within the walker 100. This selective connection may include, but is not limited to, a latch-and-eyelet connection, a magnetic connection, a Velcro® connection, a snap fastener connection, a button connection, connections where a protrusion on the rear portion 116 is held in place in a channel or depression on the right portion 108 with a moveable lever or arm, and any other connection that selectively connects the distal end of the rear portion 116 and the first end of the right portion 108. One skilled in the art will appreciate that the selective connection and hinged connection 140 in FIG. 1 are merely exemplary in nature, and these connections may be positioned between any portions of the walker 100 in any combination.

FIG. 1 shows an adjustable strap 132 disposed between the front portion 112 and the rear portion 116 of the walker 100. In this embodiment, the adjustable strap 132 is connected to the front portion 112, and the adjustable strap 132 is operatively connected to a retraction device 128, which is connected to the rear portion 116. The adjustable strap 132 is generally centered on the front portion 112, and the retraction device 128 is generally centered on the rear portion 116. In other embodiments, the retraction strap 132 may include a retraction device 128 at both ends, and in yet further embodiments, the retraction strap 132 may have more than two ends disposed on one or more portions of the walker 100.

The retraction device 128 may be any device that retracts or extends an end of the adjustable strap 132. Examples of possible retraction devices 128 include, but are not limited to, a snubbing winch, a wakeskate winch, a glider winch, an air winch, a hoist, a pulley, and a winch puller. In addition, the possible sources of power for the retraction device 128 include, but are not limited to, an AC motor, a DC motor, hydraulic power, pneumatic power, solar power, an internal combustion engine, and a hand crank. Embodiments of the retraction device 128 may include a ratchet and pawl system to prevent the adjustable strap 132 from inadvertently extending unless the pawl is retracted. Again, one skilled in the art will appreciate embodiment of the present invention where the adjustable strap 132 has two or more ends, and more than one retraction device 128 is employed to retract or extend the two or more ends of the adjustable strap 132.

A seat 136 is optionally disposed on the adjustable strap 132 in the embodiment depicted in FIG. 1. The seat 136 may be connected or selectively connected at any point along the adjustable strap 132. The seat 136 may be a conventional seat like a bicycle seat or a seat cushion. The seat 136 may also be an unconventional seat such as a bar or ball. In some embodiments, the seat 136 is a modular design. A receiving portion may be disposed on any point along the adjustable strap 132. Then a seat portion may be selectively connected to the receiving portion to provide a seat 136 on the adjustable strap 132. With this two-piece configuration, a given walker 100 may accommodate any user and his or her personal seat. In some embodiments, the seat 136 and/or adjustable strap 132 may include lights such as LEDs or glow-in-the-dark materials or paints to illuminate the seat 136 and/or adjustable strap 132 in dimly-lit conditions.

The walker 100 in FIG. 1 comprises a left leg set and a right leg set. The right leg set comprises a fore leg 120 and an aft leg 124. In this embodiment, the legs 120, 124 each comprise a proximate end positioned on the right portion 108 and a distal end positioned near the ground. The proximate ends of the legs 120, 124 are each disposed in a channel on the underside of the right side 108. Thus, the proximate ends of the legs 120, 124 are allowed to translate positions along a longitudinal axis of the right side 108. Next, the fore leg 120 and the aft leg 124 are hingedly connected to one another at a midpoint of the fore leg 120 and a midpoint of the aft leg 124 or any other point along the fore leg 120 or aft leg 124. Therefore, as the proximate ends of the legs 120, 124 translate positions in their respective channels, the legs 120, 124 move about each other in a scissor-like fashion. The legs 120, 124 may selectively lock in place in their respective channels when the legs 120, 124 are in a collapsed position, when the legs 120, 124 are in an extended position, or any position in between. The collapsibility of the leg sets allow for a compact reduction in size of the walker 100. As mentioned above, the connections between the portions 104, 108, 112, 116 may all be hinged or otherwise movable relative to one another. Therefore, during operation the leg sets may be collapsed and the portions 104, 108, 112, 116 may be folded against one another to form a fully collapsed walker 100 that may fit into a brief case or small location.

In a further embodiment, hydraulic devices may be disposed on either side of the hinged connection between the fore leg 120 and the aft leg 124 such that extension and retraction of a hydraulic piston moves the legs 120, 124 in a scissor-like fashion. One skilled in the art will appreciate other location to dispose the hydraulic pump such as in the above-mentioned channels among other locations. In addition, instead of having the portions 104, 108, 112, 116, some embodiments of the present invention may comprise only a single, continuous portion. In this embodiment, the scissor-like actuation of the legs 120, 124 allows the walker 100 to collapse to the ground, then a user may position themselves over the adjustable strap, and the scissor-like movement of the legs 120, 124 may raise the single, continuous portion upwards to enclose the user.

The left leg set in FIG. 1 is generally identical to the right leg set; the left leg set comprise a fore leg and an aft leg. One skilled in the art will appreciate embodiments where the left leg set is not generally identical to the right leg set. Further, one skilled in the art will appreciate embodiments of the present invention that have one leg set, no leg sets, or more than two leg sets.

One skilled in the art will appreciate a variety of dimensions of the walker 100. For example, in some embodiments, the left portion 100 is between approximately 42" and 48" in length, wherein "approximately" implies variation of +/−10%. In various embodiments, the left portion 100 is between approximately 30" and 60" in length. The right portion 108 may be identical in length to the left portion 104 in some embodiments. In alternative embodiments, the right portion 108 may comprise two pieces wherein the selective connection to define the user region exists between the two right portion 108 pieces and not between the right portion 108 and the rear portion 116. In this embodiment, a fore piece of the right portion 108 is between approximately 32" and 40". In a preferred embodiment, the right portion 108 is 36". An aft piece of the right portion 108 is between approximately 6" and 12". In a preferred embodiment, the aft piece of the right portion 108 is approximately 8".

Figure 2:
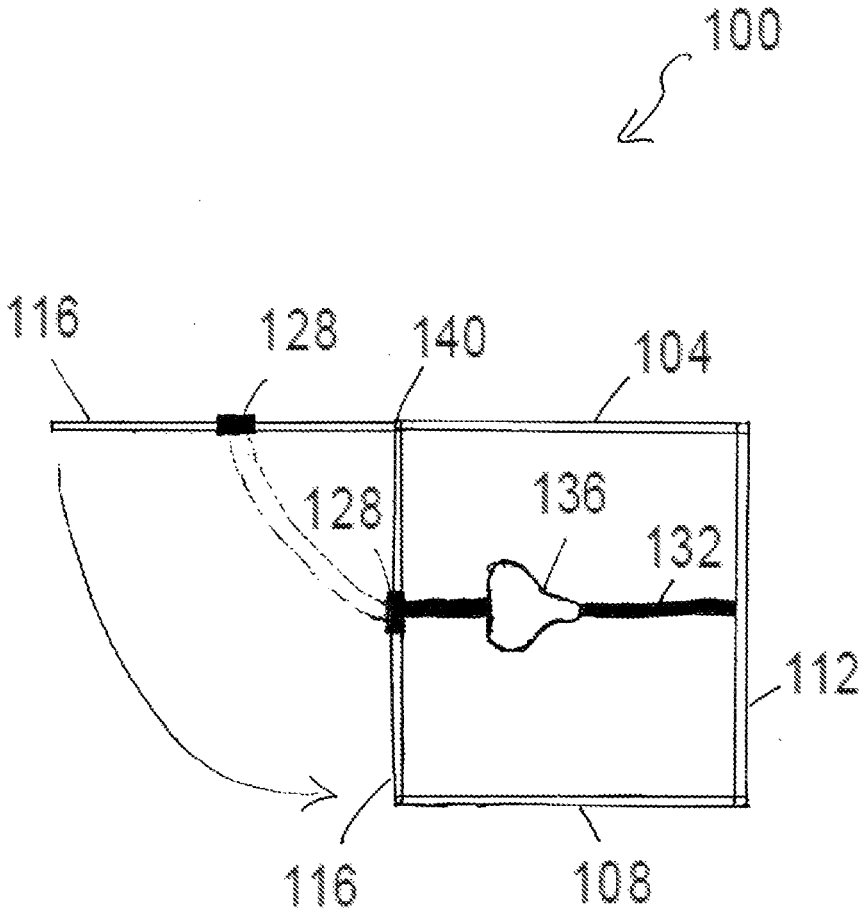
FIG. 2 depicts a top plan view of an embodiment of a walker with an adjustable strap.

FIG. 2 shows a top plan view of a walker 100 with an adjustable strap 132. From this view, the open and closed positions of the rear portion 116 are shown. In the closed position, a distal end of the rear portion 116 contacts a first end of the right portion 108 to define a user region and form a perimeter around the user. When the rear portion 116 is in an open position, the rear portion 116 is coaxial with the left portion 104, and in other embodiments the rear portion 116 is not coaxial with the left portion 104. In some embodiments, the rear portion 116 may lock into this open position. For example, a deflectable protrusion may be disposed on the proximate end of the rear portion 116 that deflects as the rear portion 116 is opening then extends or "pops" into place into a depression in a first end of the left portion 104. A mechanically-linked or electronically-linked connection may depress the protrusion and allow the rear portion 116 to close. This protrusion-depression combination may be located anywhere on the walker 100.

Figure 3:
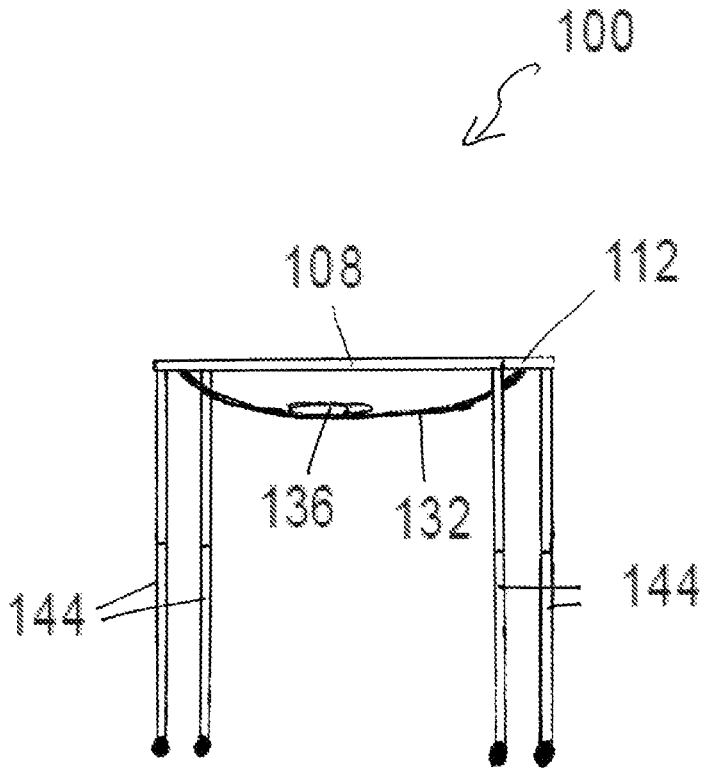
FIG. 3 depicts a side elevation view of an embodiment of a walker with an adjustable strap and telescoping legs.

FIG. 3 shows a side elevation view of a walker 100 with an adjustable strep 132. As in other embodiments described herein, four portions form a square or rectangle around a user, wherein an adjustable strap is disposed between a rear portion 116 and a front portion 112. In the embodiment illustrated in FIG. 3, the walker 100 has four legs 144 that descend downwardly from the four connections between the four portions.

The four legs 144 provide a way to adjust the height of the walker 100. The legs 144 are telescoping in nature. That is, in this embodiment, a lower portion of a leg 144 is at least partially disposed in an upper portion of the leg 144. The lower portion of the leg 144 is selectively positioned at various longitudinal lengths within the upper portion of the leg 144. In one embodiment, a plurality of apertures is disposed on the outer surface of the upper portion of the leg 144. The lower portion of the leg 144 comprises a deflectable protrusion that deflects, extends, or "pops" into place in one of the apertures of the upper portion. To adjust the position of the lower portion of the leg 144, and thus the height of the walker 100, a user may depress the protrusion on the lower portion of the leg 144 while simultaneously pushing or pulling the lower portion of the leg 144 to a different longitudinal position relative to the upper portion of the leg 144.

One skilled in the art will appreciate variations of the telescoping legs 144. First, one skilled in the art will appreciate positions adjustment mechanisms beyond the aperture-protrusion combination. For example, the upper and lower portions of the leg 144 may slide freely relative to each other. A clamp disposed on the upper portion of the leg 144 may selectively press into the side of the lower portion of the leg 144 such that the longitudinal position of the lower portion is fixed relative to the upper portion of the leg 144. In some embodiments, the upper portion of the leg 144 may be disposed within the lower portion of the leg 144. In various embodiments, the telescoping leg 144 may comprise more than two portions.

Figure 4:
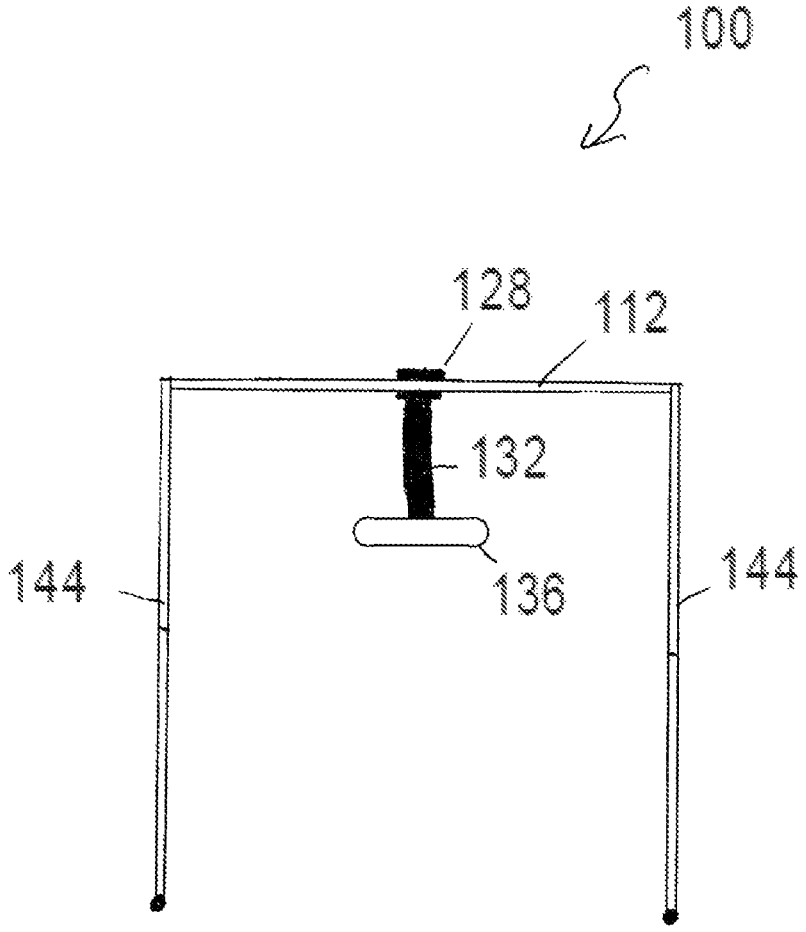
FIG. 4 depicts a front elevation view of an embodiment of a walker with an adjustable strap and telescoping legs.

FIG. 4 shows a front elevation view of the walker 100 with an adjustable strap 132. Similar to previous embodiments, the walker 100 in FIG. 4 has four portions that form a rectangle or square around a user where an adjustable strap is connected to a rear portion 116 and a front portion 112. The legs 144 are telescoping in nature, and the position of a lower portion of the legs 144 may be adjusted relative to the position of an upper portion of the legs 144 to adjust the height of the walker 100.

Also shown in FIG. 4 is a seat 136 positioned on the adjustable strap 132. Embodiments of the seat 136 as a two-piece design are discussed elsewhere herein, but one skilled in the art will appreciate further seat 136 designs. For example, in one embodiment the seat 136 is not secured to the adjustable strap 132, and the position of the seat 136 is not fixed. In some embodiments, the seat 136 may comprise protrusions that contact the adjustable strap 132 to provide friction between the seat 136 and the adjustable strap 132. Thus, the seat 136 may translate positions along the adjustable strap 132 if a large enough force is applied to the seat 136, but the seat 136 may remain in place relative to the adjustable strap 132 if the threshold force is not applied. In yet other various embodiments, the plurality of snap fasteners may be used to locate the seat 136 relative to the adjustable strap. The seat 136 may include a first portion of a snap fastener, and the adjustable strap 132 may include a plurality of second snap fastener portions. Thus, the seat 136 may snap into a discrete number of locations along the adjustable strap 132.

Figure 5:
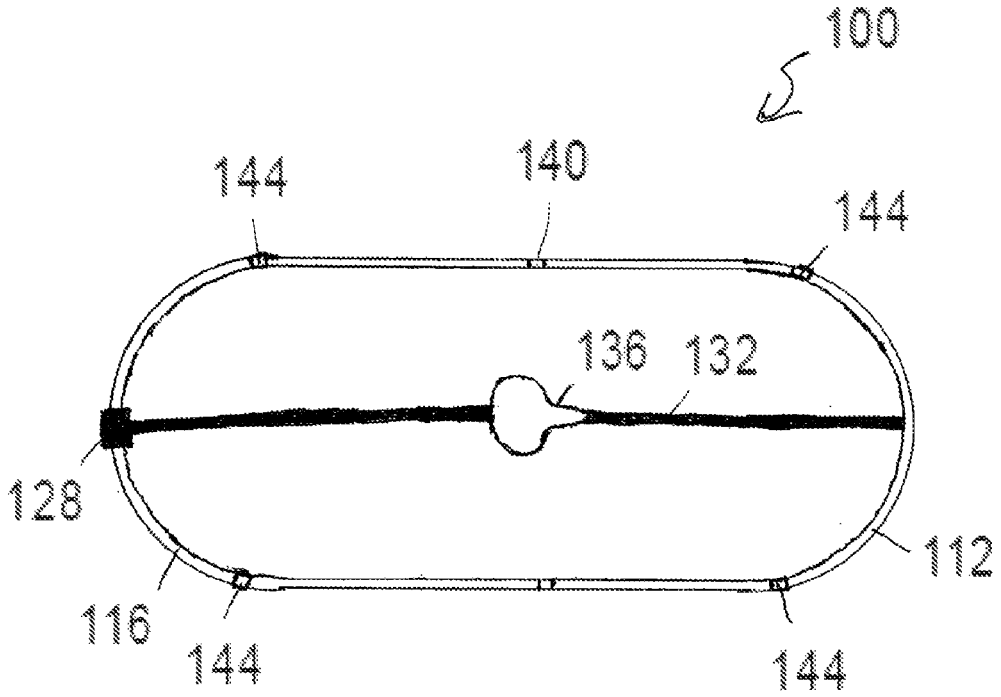
FIG. 5 depicts a top plan view of an embodiment of a walker with an adjustable strap and two segments with radii of curvature.

FIG. 5 depicts an alternative embodiment of the walker 100 with an adjustable strap 132. In this embodiment, there are only two portions: the front portion 112 and the rear portion 116. The front portion 112 has a segment with a radius at one end of the walker 100. At the ends of the segment, the front portion 112 extends into two tubular sections that are a parallel to each other. The rear portion 116 is symmetric to the front portion 112 in this embodiment, and the two tubular sections from the front portion 112 meet the two tubular sections of the rear portion 116 at a hinged connection 140 and a selective connection. These connections may be any type of connections discussed elsewhere herein or otherwise commonly known in the art.

Four legs 144 are disposed at different locations on the walker 100. In the embodiment illustrated in FIG. 5, two legs 144 are disposed on the rear portion 116, and two legs 144 are disposed on the front portion 112. The two legs 144 on the rear portion 116 are positioned symmetric to the two legs 144 on the front portion 112 about a lateral plane through the walker 100. The two legs 144 on the right side of the walker 100 are positioned symmetric to the two legs 144 on the left side of the walker 100 about a longitudinal plane through the walker 100. One skilled in the art will appreciate other embodiments that are not symmetric about one or both of these planes.

Figure 6:
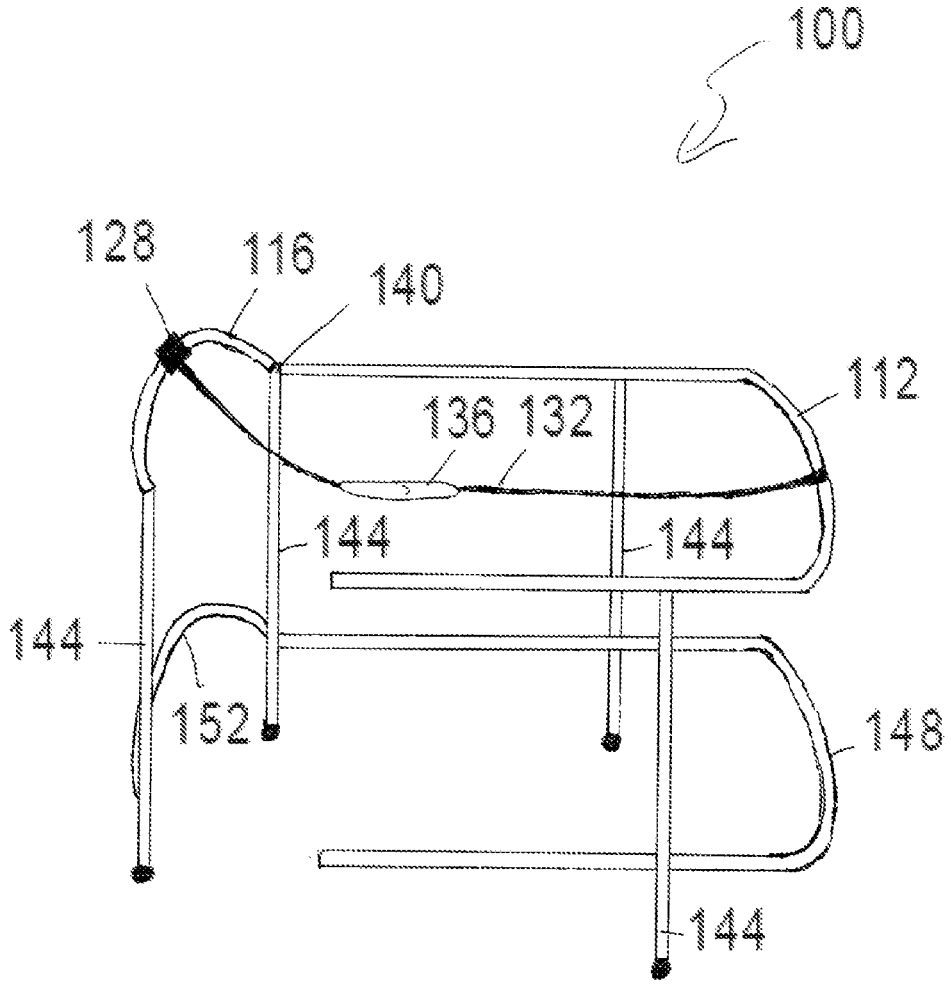
FIG. 6 depicts an isometric view of an embodiment of a walker with an adjustable strap and two segments with radii of curvature.

FIG. 6 depicts an embodiment of the walker 100 with an adjustable strap 132 wherein the front portion 112 and the rear portion 116 have segments comprising a radius. This embodiment further comprises a lower front portion 148 and a lower rear portion 152 that are shaped like the front portion 112 and rear portion 116, respectively. However, the lower portions 148, 152 are disposed closer to the ground surface and add rigidity and sturdiness to the overall walker 100.

The relative spacing between the portions 112, 116 and the lower portions 148, 152 can take many forms. For example, in the embodiment depicted in FIG. 6, the lower portions 148, 152 are connected to the legs 144, which in turn extend downward and contact the ground either directly or via another component such as wheels, without or without spring dampeners. In alternative embodiments, the legs 144 terminate at the lower portions 148, 152. Then, wheels, skis, treads, etc. may be connected to the lower portions 148, 152. Thus, in some embodiments, the lower portions 148, 152 are disposed between approximately 0" and 12" from the ground. In various embodiments, the lower portions 148, 152 are disposed between approximately 3" and 8" from the ground.

The lower portions 148, 152 may also be disposed more proximate to the front portion 112 and the rear portion 116. In one embodiment, the lower portions 148, 152 are disposed adjacent to the portions 112, 116 to provide added rigidity and sturdiness to the overall walker 100. In some embodiments, the lower portions 148, 152 are spaced between approximately 0" and 12" below the portions 112, 116. In various embodiments, the lower portions 148, 152 are spaced between approximately 3" and 8" below the portions 112, 116. One skilled in the art will appreciate that the lower portions 112, 116 may be disposed at any point along the legs 144, including the midpoint of the legs 144.

In addition, one skilled in the art will appreciate a variety of lower portion 148, 152 combinations that add rigidity and sturdiness to the overall walker 100. For example, the walker 100 may comprise more than one set of lower portions 148, 152. In some embodiments, there may be more than one lower portions that correspond to more than one portions as noted in above embodiments that comprise four portions arranged in a square or rectangle.

In the embodiment depicted in FIG. 6, the lower portions 148, 152, are made of a tubular shaped material. In alternative embodiments, the lower portions 148, 152 may be solid tubular portions or solid portions of another shape such as hexagonal. Further yet, the lower portions 148, 152 may be straps, ropes, cords, wires, magnetic couplings, etc.

One skilled in the art will appreciate a variety of dimensions of the walker 100 in FIG. 6. For example, the overall longitudinal length of the front portion 112 is between approximately 12" and 24". In a preferred embodiment, the overall longitudinal length of the front portion 112 is approximately 18". The overall longitudinal length of the rear portion 116 is between approximately 2" and 16". In a preferred embodiment, the overall longitudinal length of the rear portion 116 is approximately 6". The height of the legs 144 is between approximately 20" and 40". In a preferred embodiment, the height of the legs 144 is approximately 30".

Figure 7:
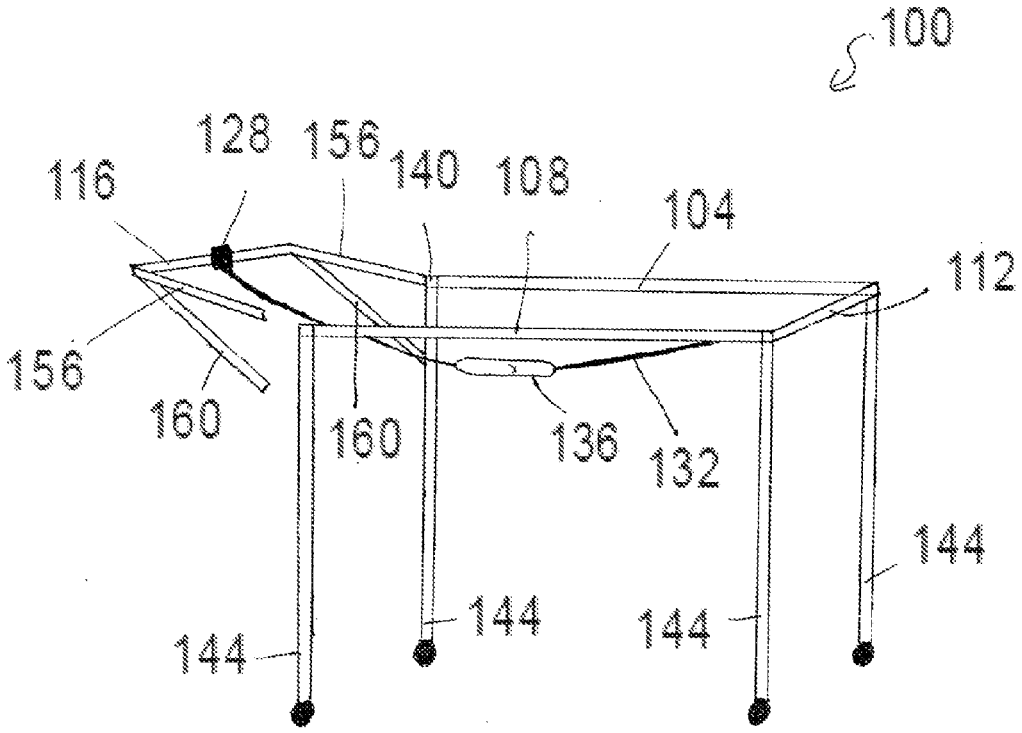
FIG. 7 depicts an isometric view of an embodiment of a walker with an adjustable strap and two additional support portions.

FIG. 7 depicts an isometric view of a walker 100 that comprises an adjustable strap 132 and a plurality of planar support portions 156 and angled support portions 160. The planar support portions 156 extend rearward of the left portion 104 and the right portion 108. Then, the rear portion 116 is disposed between the planar support portions 156. From the point where the rear portion 116 and a planar support portion 156 meet, an angled support portion 160 descends downwardly at an angle from a generally horizontal plane. In this embodiment, the angled support portion 160 extends toward a leg 144 descending from the right portion 108. Similarly and symmetrically, an angled support portion 160 descends downwardly from a rear portion 116-planar support portion 156 connection at an angle from a generally horizontal plane, and the angled support portion 160 extends toward a leg 144 descending from the left portion 104.

In the embodiment depicted in FIG. 7, the planar support portion 156 and the angled support portion 160 that are proximate to the left portion 104 are hingedly connected to the left portion 104 and the leg 144 that descends from the left portion 104, respectively. This hinged connection allows the rear portion 116, planar support portions 156, and angled support portions 160 to fully enclose the user within a user region of the walker 100. The hinged connection may be any hinged-type connection discussed elsewhere herein or otherwise commonly known in the art.

In various embodiments of the invention, each of the planar support portion 156 and the angled support portion 160 proximate to the left portion 104 comprise a hinged connection to the left portion 104 and the leg 144 that descend from the left portion 104, respectively. In alternative embodiments, an intermediate portion may extend between the distal ends of the planar and angled support portions 156, 160, and the intermediate portion is hingedly connected to the left portion 104 or the leg 144 descending from the left portion 104.

The planar support portion 156 and the angled support portion 160 that are proximate to the right portion 108 selectively connect to the right portion 108 and the leg 144 that descends from the right portion 108, respectively. This selective connection allows a the combination of the rear portion 116, the planar support portions 156, and the angled support portions 160 to latch into place and define a user region and fully enclose the user. The selective connection may be any device or method discussed elsewhere herein or otherwise commonly known in the art.

In various embodiments of the invention, an intermediate portion may extend between the distal ends of the planar and angled support portions 156, 160 proximate to the right portion 108, and the intermediate portion is selectively connected to the right portion 108 or the leg 144 descending from the right portion 108.

One skilled in the art will appreciate a variety of dimensions of the walker 100 in FIG. 7. In some embodiments, the width of the front portion 112 is between approximately 18" and 26". In a preferred embodiment, the width of the front portion 112 is approximately 20". In various embodiments, the length of the planar support portions 156 is between approximately 2" and 12". In a preferred embodiment, the length of the planar support portions 156 is approximately 6". The height of the legs 144 is between approximately 20" and 40". In a preferred embodiment, the height of the legs 144 is approximately 30".

Figure 8:
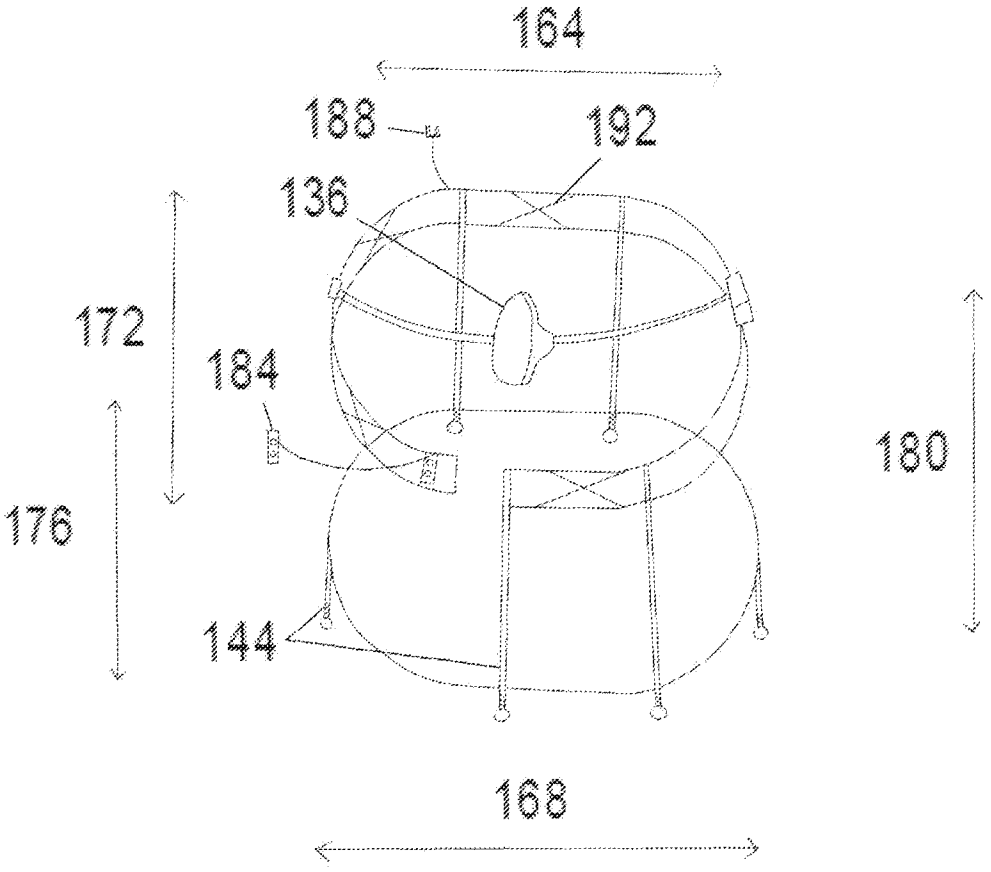
FIG. 8 depicts an isometric view of an embodiment of the walker with an adjustable strap and two addition support portions.

FIG. 8 depicts a walker 100 that has an upper frame and a lower frame wherein the frame have different dimensions. The upper frame's length 164 represents the largest dimension of the upper frame's ovoid shape. In some embodiments, the upper frame's length 164 is between approximately 20" and 40". In other embodiments, the upper frame's length 164 is between approximately 25" and 35". In one embodiment, the upper frame's length 164 is 30".

A lower frame's length 168 is the largest dimension of the lower frame's ovoid shape. In some embodiments, the lower frame's length 168 is between approximately 26" and 46". In other embodiments, the lower frame's length 168 is between approximately 31" and 41". In one embodiment, the lower frame's length 168 is 36". In this embodiment, the lower frame is larger in size than the upper frame, but it will be appreciated that the lower frame may also be equal or smaller in size than the upper frame.

The walker in FIG. 8 also has an upper frame width 172 and a lower frame width 176. In some embodiments, the upper frame's width 172 is between approximately 12" and 32". In other embodiments, the upper frame's width 172 is between approximately 17" and 27". In one embodiment, the upper frame's width 172 is 22". In some embodiments, the lower frame's width 176 is between approximately 17" and 37". In other embodiments, the lower frame's width 176 is between approximately 22" and 32". In one embodiment, the lower frame's width 176 is 27". In this embodiment, the lower frame is larger in size than the upper frame, but it will be appreciated that the lower frame may also be equal or smaller in size than the upper frame.

The upper frame and the lower frame of the walker 100 are separated by a predetermined distance known as the frame distance 180. In some embodiments, the frame distance 180 is between approximately 20" and 40". In other embodiments, the frame distance 180 is between approximately 25" and 35". In one embodiment, the frame distance 180 is 30".

The walker 100 depicted in FIG. 8 also has a number of components. A control 184 allows a user to operate the retractable or adjustable strap among other functions discussed elsewhere herein. The outlet plug 188 communicates electrical energy from an outlet to the walker 100. It will be appreciated that the outlet plug is not the only way to energize the walker 100. The walker 100 may be battery-powered, or powered by any other source of energy described elsewhere herein. The seat 136 in this embodiment comprises a seat belt, which may be used to secure a user to the seat 136 and prevent the user from slipping off of the seat 136. The legs 144 in FIG. 8 are spring-loaded, meaning that the legs 144 comprise a spring disposed at a lower end of the legs 144 to provide a dampening effect as the walker 100 is used and moved.

The walker 100 also comprises a banner 192 disposed under the upper frame. The banner 192 can display messages for walker's 100 user. For example, the banner 192 may indicate what medications the user is taking or other medical signals. Further, the banner 192 may include messages about the user such as "I am a Vietnam Veteran", the user's church information, holiday slogans, or other identifying information about the user, the user's location, or the user's environment. The banner 192 in this embodiment is interconnected underneath the top frame. However, it will be appreciated that the banner 192 may be interconnected to any component of the walker, including, but not limited to, the lower frame, the seat, the strap, the power source, the legs, the wheels, the controls, and any positions on these components. For example, on the front section of the upper frame or the rear section of the upper frame, facing inward or outward. The banner may be interconnected to the walker 100 using any means commonly known in the art. This may include glue, screws, Velcro®, hook-and-loop fasteners, etc.

The exemplary devices and methods of this disclosure have been described in relation to a walker with an adjustable strap and associated devices. However, to avoid unnecessarily obscuring the present disclosure, the preceding description omits a number of known structures and devices. This omission is not to be construed as a limitation of the scopes of the claims. Specific details are set forth to provide an understanding of the present disclosure. It should however be appreciated that the present disclosure may be practiced in a variety of ways beyond the specific detail set forth herein. A number of variations and modifications of the disclosure can be used. It would be possible to provide for some features of the disclosure without providing others.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A walker for assisting a user, comprising:

a frame partially enclosing an interior of the frame, the frame oriented substantially horizontal to a ground surface;

a plurality of legs connected to the frame and descending downwardly from the frame;

an arcuate rear portion having a proximate end and a distal end, the proximate end rotatably connected to the frame, the arcuate rear portion extending outwardly relative to the interior of the frame, wherein the arcuate rear portion rotates about the rotatable connection such that the distal end selectively connects to and disconnects from the frame, which fully encloses the interior of the frame;

an adjustable strap having a first end, a second end, and a length between the first and second ends of the adjustable strap;

a retraction device disposed on the arcuate rear portion, wherein the first end of the adjustable strap is operatively connected to the retraction device, and the second end of the adjustable strap is connected to the walker, wherein the retraction device retracts and extends the adjustable strap between a first length and a second length, wherein the first length is longer than the second length and wherein in a first operational mode the first length enables a user to enter the interior of the frame, while the adjustable strap is operatively connected to the retraction device and the frame of the walker and the arcuate rear portion is disconnected from the frame, and position the adjustable strap between legs of the user and in a second operational mode the adjustable strap is retracted to the second length; and a seat disposed between the first end and the second end of the adjustable strap, wherein when, in the second operational mode, the retraction device retracts the adjustable strap to the second length the seat contacts the user and bears at least some of the user's weight, wherein at least a segment of the arcuate rear portion comprises a radius of curvature, and wherein at least a segment of the frame comprises a radius of curvature and wherein the retraction device is electrically connected to a power supply supported by the walker and wherein a switch enables the user to control the wind and unwind operations of the retraction device.

2. The walker of claim 1, wherein the plurality of legs descends downwardly and at an angle perpendicular to the frame and wherein the distal end of the arcuate rear portion is unsupported by a lower rear portion disposed between the rear arcuate portion and the ground surface.

3. The walker of claim 1, wherein the plurality of legs operatively engage a plurality of wheels.

4. The walker of claim 1, further comprising:

a lower front portion disposed between the frame and the ground, wherein at least one leg is connected to the lower front portion; and a lower arcuate rear portion disposed between the rear arcuate portion and the ground surface.

5. The walker of claim 1, wherein the retraction device automatically retracts the adjustable strap from the first length to the second length after a delay period, wherein the delay period begins after the arcuate rear portion selectively connects to the frame.

6. The walker of claim 1, wherein the first end of the adjustable strap is operatively connected to the retraction device at a single point, and the second end of the adjustable strap is connected to the frame at a single point and wherein a delay period is zero seconds.

7. A method for adjusting the strap of a walker, comprising:

providing a walker, comprising:

a frame partially enclosing an interior of the frame, the frame oriented generally horizontal to a ground surface;

a plurality of legs connected to the frame and descending downwardly from the frame;

an arcuate rear portion having a proximate end and a distal end, the proximate end rotatably connected to the frame, the arcuate rear portion extending outwardly relative to the interior of the frame;

an adjustable strap having a first end, a second end, and a length between the first and second ends of the adjustable strap, wherein the first end and second ends of the adjustable strap are operatively connected to the walker;

a seat disposed between the first end and the second end of the adjustable strap; and a retraction device positioned on the walker, wherein the first end of the adjustable strap is operatively connected to the retraction device, the retraction device retracts and extends the adjustable strap between a first length and a second length, the retraction device is electrically connected to a power supply supported by the walker, and a switch enables a person to control the wind and unwind operations of the retraction device;

extending the adjustable strap to the first length to enable the person to enter the interior of the frame, while the adjustable strap is operatively connected to the retraction device and the frame of the walker and the arcuate rear portion is disconnected from the frame;

receiving the person within the interior of the frame, wherein the person is centered over the adjustable strap and the seat, and wherein the adjustable strap is positioned between legs of the person;

rotating the arcuate rear portion to selectively connect to the frame and enclose fully the interior of the frame; and retracting the adjustable strap from the first length to the second length, wherein the second length is shorter than the first length, and wherein the seat contacts the person and bears at least some of the person's weight.

8. The method of claim 7, wherein the changing the length of the adjustable strap automatically occurs a delay period after the rotating of the arcuate rear portion to enclose the interior of the frame and wherein the distal end of the arcuate rear portion is unsupported by a lower rear portion disposed between the rear arcuate portion and the ground surface.

9. The method of claim 8, wherein the delay period is zero seconds.

10. The method of claim 7, wherein the plurality of legs extend downwardly and at an angle perpendicular to the frame, wherein the distal end of the arcuate rear portion is unsupported by a lower rear portion disposed between the rear arcuate portion and the ground surface.

11. The method of claim 7, wherein the plurality of legs operatively and collectively engage more than four wheels, and wherein when the seat bears at least some of the person's weight, the seat bears between approximately 50% to 100% of the person's weight.

12. The method of claim 7, wherein at least a segment of the arcuate rear portion comprises a radius of curvature, and wherein at least a segment of the frame comprises a radius of curvature.

13. The method of claim 7, wherein the walker further comprises:

a lower front portion disposed between the frame and the ground, wherein at least one leg is connected to the lower front portion; and a lower rear portion disposed between the arcuate rear portion and the ground.

14. A walker for assisting a user, comprising:

a plurality of legs connected to a frame and descending downwardly from the frame;

a rear portion having a proximate end and a distal end, the proximate end rotatably connected to the frame, wherein the rear portion rotates about the rotatable connection such that the distal end selectively connects to and disconnects from the frame, which fully encloses an interior of the frame;

an adjustable strap having a first end, a second end, and a length between the first and second ends of the adjustable strap;

a retraction device disposed on the rear portion, wherein the first end of the adjustable strap is operatively connected to the retraction device, wherein the second end of the adjustable strap is connected to the walker, wherein the retraction device retracts and extends the adjustable strap between a first length and a second length, wherein the first length is longer than the second length, wherein in a first operational mode the first length enables a user to enter the interior of the frame, while the adjustable strap is operatively connected to the retraction device and the frame of the walker and the rear portion is disconnected from the frame, and position the adjustable strap between legs of the user and in a second operational mode the adjustable strap is retracted to the second length, and wherein the retraction device is an electric motor that converts electrical energy to retract and extend the adjustable strap between the first length and the second length; and a seat disposed between the first end and the second end of the adjustable strap, wherein when the retraction device retracts the adjustable strap to the second length the seat contacts the user and bears at least some of the user's weight;

wherein the plurality of legs descends downwardly at an angle perpendicular to the frame.

15. The walker of claim 14, wherein the rear portion is arcuate in shape, the arcuate rear portion extending outwardly relative to the interior of the frame being enclosed by the frame, wherein the first end of the adjustable strap is operatively connected to the retraction device at a single point, wherein the distal end of the arcuate rear portion is unsupported by a lower rear portion disposed between the rear arcuate portion and the ground surface, wherein the plurality of legs operatively engage a plurality of wheels, and wherein the plurality of wheels comprise more than four wheels.

16. The walker of claim 15, wherein the second end of the adjustable strap is connected to the frame at a single point and further comprising:

a lower front portion disposed between the frame and the ground, wherein at least one leg is connected to the lower front portion; and a lower arcuate rear portion disposed between the arcuate rear portion and the ground surface, wherein the distal end of the arcuate rear portion is unsupported by the lower arcuate rear portion.

* * * * *